US006168641B1

(12) United States Patent
Tuvin et al.

(10) Patent No.: US 6,168,641 B1
(45) Date of Patent: Jan. 2, 2001

(54) CYCLONE SEPARATOR DEVICE FOR A VACUUM CLEANER

(75) Inventors: Lars Tuvin, Knivsta; Lars Kilström, Täby; Stefan Petersson; Patrik Pastuhoff, both of Västervik, all of (SE)

(73) Assignee: Akteibolaget Electrolux, Stockholm (SE)

( * ) Notice: Under 35 U.S.C. 154(b), the term of this patent shall be extended for 0 days.

(21) Appl. No.: 09/334,368

(22) Filed: Jun. 16, 1999

(30) Foreign Application Priority Data

Jun. 26, 1998 (SE) ..... 9802283
Apr. 8, 1999 (SE) ..... 9901252

(51) Int. Cl.[7] ..... B01D 45/16; B01D 50/00

(52) U.S. Cl. ..... 55/337; 55/399; 55/429; 55/459.1; 55/460; 55/DIG. 3

(58) Field of Search ..... 55/318, 337, 399, 55/447, 454, 458, 459.1, 459.2, 460, 482, 485, 493, DIG. 3, 320, 429

(56) References Cited

U.S. PATENT DOCUMENTS 2,375,608 * 5/1945 Young .
4,099,937 * 7/1978 Ufken et al. .
4,251,241 * 2/1981 Bothun .
4,593,429 * 6/1986 Dyson .
5,080,697 * 1/1992 Finke .
5,145,499 * 9/1992 Dyson .
5,350,432 9/1994 Lee .

FOREIGN PATENT DOCUMENTS

2305623 * 4/1997 (GB) .
2 305 623 4/1997 (GB) .
2344746 * 6/2000 (GB) .

* cited by examiner

*Primary Examiner*—David A. Simmons
*Assistant Examiner*—Fred Prince
(74) *Attorney, Agent, or Firm*—Pearne & Gordon LLP

(57) ABSTRACT

A vacuum cleaner cyclone separator having a cyclone with a first end wall, a second opposite end wall (35,36,135), and an intermediate part (38,130), which has the shape of either a cylinder or, at least partly, an up-side-down truncated cone. The intermediate part has an outlet opening (39,131) for particles through which particles separated by the cyclone leave from the intermediate part toward the second end wall. The cyclone is, close to the first end wall, provided with a generally tangentially-directed air inlet (33,129) for dust laden air and also has a tube shaped air outlet (50,142) extending from the first end wall (35) toward the intermediate part and communicating with a vacuum source (15, 111). The particle outlet opening (39,131) continues into a separation part (40,134) having a side wall opening (41,137) through which the particles leave mainly perpendicular to the rotational axis (R) of the vortex created in the cyclone to a particle collecting (27) container placed outside the separation part (40,134).

22 Claims, 7 Drawing Sheets

CYCLONE SEPARATOR DEVICE FOR A VACUUM CLEANER

BACKGROUND OF THE INVENTION

The present invention generally relates to a vacuum cleaner cyclone separator having a cyclone including first and second opposing end walls, and an intermediate part having either a cylindrical shape or an at-least partially frusto-conical shape. The intermediate part has an outlet opening through which particles separated by the cyclone separator exit from the intermediate part toward the second end wall. Close to the first end wall the cyclone has a mainly tangentially-directed air inlet for dust laden air and a tube-shaped air outlet extending from the first end wall toward the intermediate part and communicating with a vacuum source.

Vacuum cleaners provided with cyclone separators are known in the art, see for instance GB-A-2305623. Such cyclone separators are rather space demanding because of various requirements of the separator. Firstly, the axis of symmetry of the cyclone is usually vertically arranged. Secondly, the cyclone has to have a certain vertical extension. Thirdly, the distance between the particle outlet opening of the cyclone and the bottom of the collecting container has to be of sufficient size to permit collection of a large volume of particles. Because of these space requirements, the cyclone arrangement is suitable for so-called upright vacuum cleaners, but less suited for so-called canister vacuum cleaners because the required vertical cyclone axis arrangement increases the height of the motor housing for canister vacuum cleaners in an unacceptable way.

It has nevertheless been suggested to use cyclone separators for canister vacuum cleaners, see GB-A-2297243. The cyclone is arranged such that the vortex created in the cyclone is inclined more than 45° with respect to a horizontal plane when the vacuum cleaner is moved on a horizontal surface. The inclination of the cyclone decreases the required height while the major part of the gravity force is used to direct the particles to the container beneath the cyclone. It is possible to use this vacuum cleaner for stair cleaning purposes which means that the vacuum cleaner during such cleaning is placed on the step in such a manner that the symmetry axis will take an almost horizontal position. This position is, however, only temporary since stair cleaning normally is a minor part of the total cleaning work.

SUMMARY OF THE INVENTION

The present invention is directed toward a cyclone vacuum cleaner that has a compact structure and a large volume in the collecting container. The present invention is also directed toward a cyclone vacuum cleaner that has a simple design and, hence, is easy to manufacture. The present invention is further directed toward a cyclone vacuum cleaner that can be emptied in a simple and hygienic way.

In accordance with the present invention, a device for a vacuum cleaner includes a cyclone separator having a cyclone comprising a first end wall, a second, opposite end wall, and an intermediate part. The intermediate part is either shaped as a cylinder or, at least partly, a truncated cone. The intermediate part has a particle outlet opening through which particles separated by the cyclone leave from the intermediate part toward the second end wall. The cyclone, close to the first end wall, is provided with a generally tangentially-directed air inlet for dust laden air and has a tube-shaped air outlet extending from the first end wall into the intermediate part and communicating with a vacuum source.

In further accordance with the present invention, the particle outlet opening continues into a separation part. The separation part has a side wall opening through which particles leave generally perpendicular to an axis of rotation of a vortex created in the cyclone to a particle collecting. The particle collecting container is placed outside the separation part.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
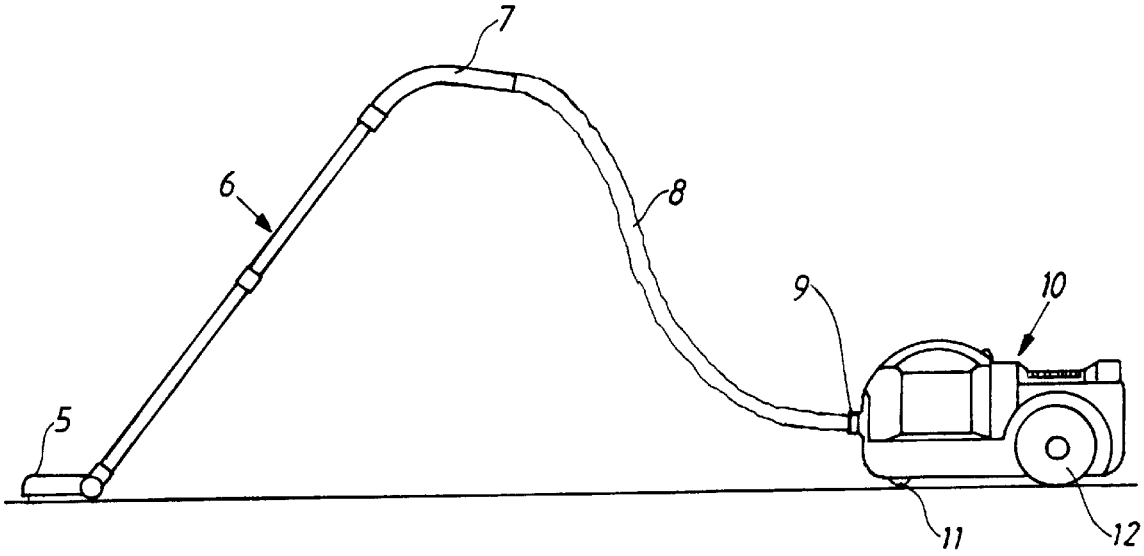
FIG. 1 schematically shows a vacuum cleaner with accessories.

With reference to FIG. 1, a vacuum cleaner has a nozzle 5 connected to a tube shaft 6 that, via a tube handle 7 and a hose 8 with a hose connection 9, is secured to a vacuum cleaner housing 10. The vacuum cleaner housing 10 is supported by a front pivot wheel 11 and two rear wheels 12.

Figure 2:
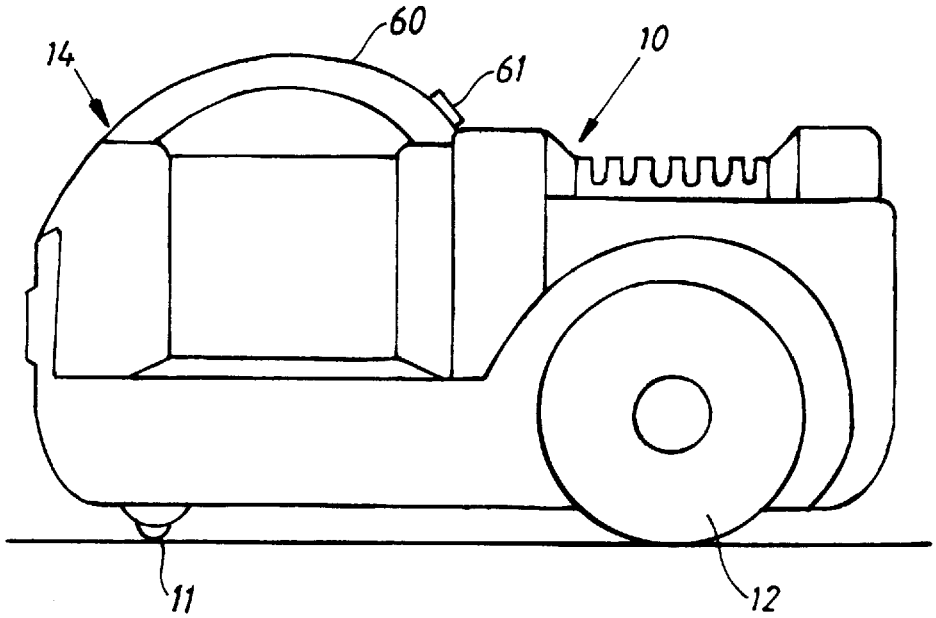
FIG. 2 is a side view of the vacuum cleaner according to the invention being provided with a liner.
Figure 3:
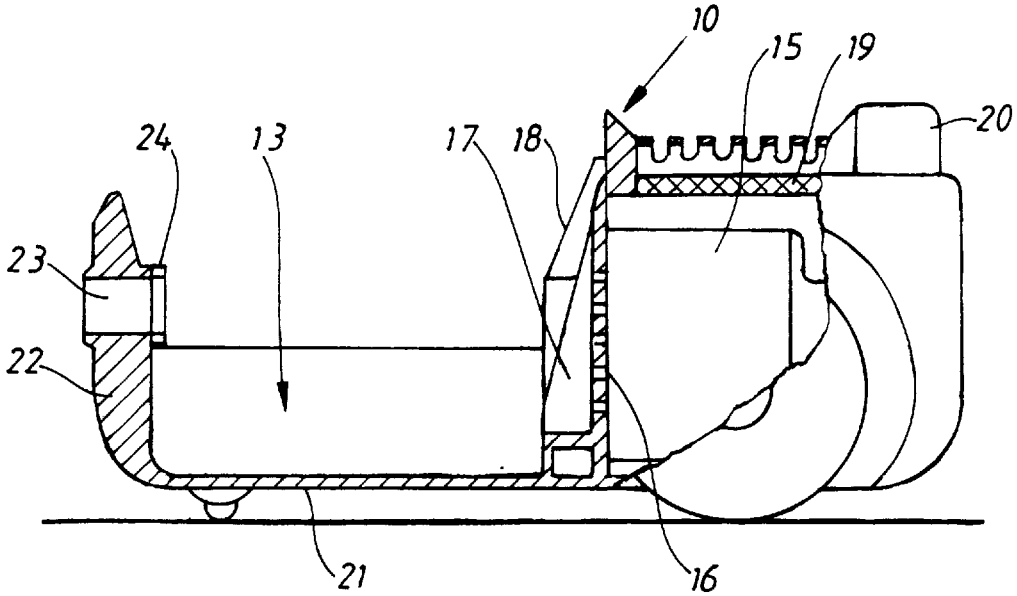
FIG. 3 is a vertical section of the vacuum cleaner shown in FIG. 2, but with the liner removed.

With reference to FIGS. 2–3, the housing 10 defines a recess 13 in which a liner 14 is removably secured. The vacuum cleaner housing 10, in a traditional manner, encloses a vacuum source such as a fan unit 15. The fan unit 15 has an inlet side that, via openings 16, is connected to an air inlet part 17. The air inlet part 17 is surrounded by an inclined, angled sealing surface 18 on which the liner 14 rests. The vacuum cleaner housing 10 also includes a replaceable outlet filter 19 through which the outlet air from the fan unit 15 leaves to atmosphere, and control means 20, other electric means, a cable reel, and other conventional features.

The vacuum cleaner housing 10 has a front end wall 22 extending upwardly from a bottom wall 21 of the housing, the bottom wall 21 defining a lower limit of the recess 13. The front wall 22 is provided with a through-tube section 23 to which the hose connection 9 can be secured. The side of the tube section 23 facing the recess is provided with an annular sealing 24 in order to seal against the liner 14.

With respect to FIGS. 4–7, the liner 14 includes three elongated, horizontal, parallel chambers that are separated from one another. These three chambers are referred to hereinafter as a coarse separator 25, a cyclone with a cyclone chamber 26, and a collecting container 27.

Figure 4:
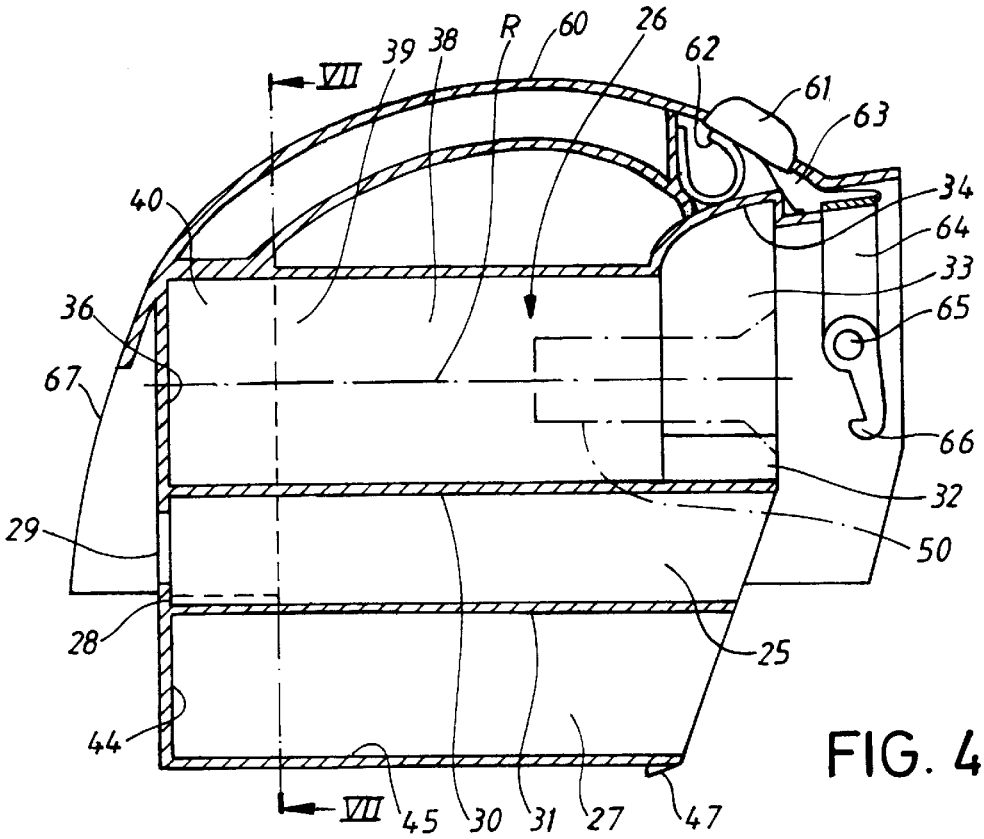
FIG. 4 is a vertical section through the liner with a cover plate, which serves as an end wall, removed.
Figure 6:
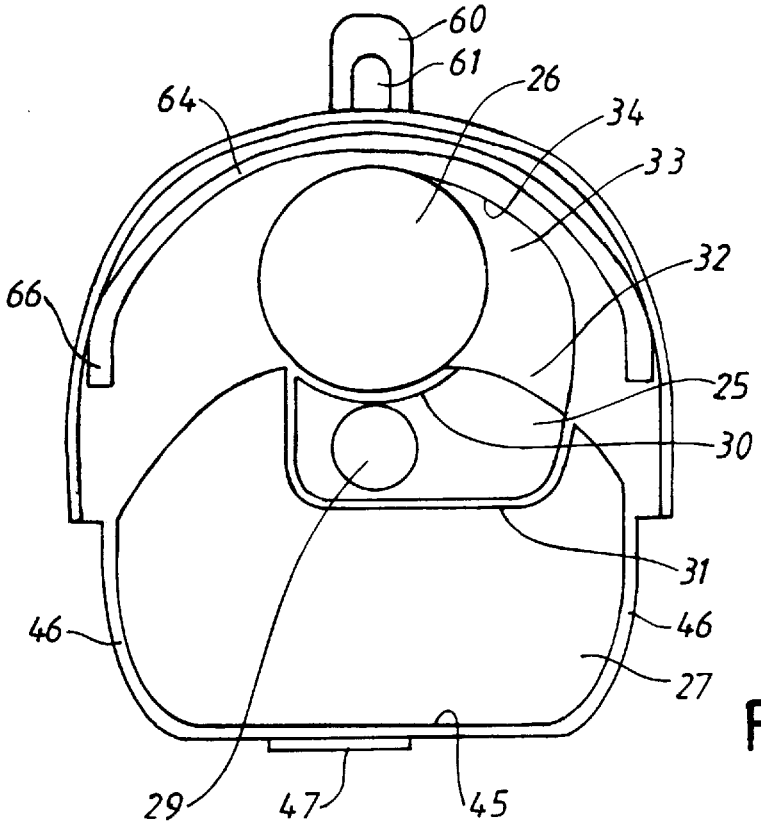
FIG. 6 is the same end view as that of FIG. 5, but with the cover plate removed.

The coarse separator 25 has an end wall 28 with an inlet opening 29 that, when the liner 14 is placed in the vacuum cleaner housing 10, is coaxial with the tube section 23. The coarse separator 25 is surrounded by a first wall part 30, which serves as a separating wall toward the cyclone chamber 26, and a second wall part 31, which serves as a separating wall toward the collecting container 27. At the end of the coarse separator 25 remote from the end wall 28, there is an opening 32 in the first wall part 30 (FIGS. 4 and 6). The opening 32 continues into an inlet channel 33 to the cyclone chamber 26, the channel 33 being arranged near one end of the cyclone chamber 26. One wall 34 of the inlet channel 33 is curved and arranged such that a mainly tangentially-directed air inlet flow is created in the cylinder-shaped cyclone chamber 26.

The cyclone chamber 26 is provided with a first end wall 35 and a second end wall 36. The first end wall 35 is a part of a cover plate 37, which will be more fully discussed hereinafter. The cyclone chamber 26 is also provided with an intermediate part 38 that is disposed between the end walls 35, 36. Preferably, the intermediate part 38 is either cylinder-shaped or is shaped as a truncated cone directed such that the smaller cone opening faces the second end wall 36. The intermediate part 38 has an opening 39 (whose diameter in the embodiment shown in FIG. 4 is identical to a diameter of the intermediate part 38) that leads to a separation part 40 positioned close to the second end wall 36.

Figure 7:
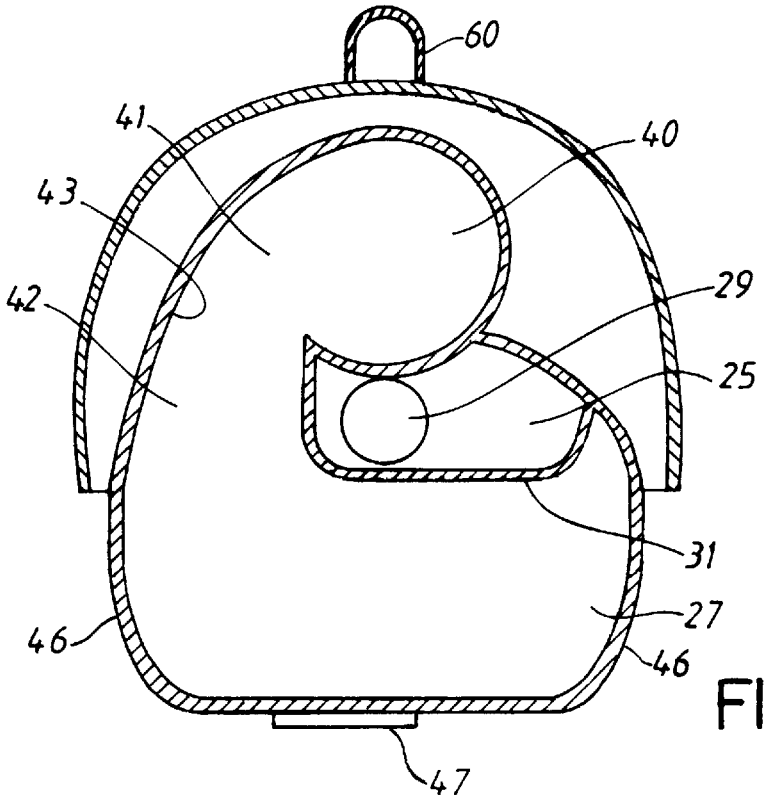
FIG. 7 is a cross-sectional view as seen along line VII—VII in FIG. 4.

With reference to FIGS. 4 and 7, the separation part 40 has an opening 41 in the side wall. The opening 41 extends almost over the complete length of the separation part 40 and is connected to a channel 42 leading to the collecting container 27. One wall 43 of the channel 42 is spiral-shaped and forms a generally tangential particle outlet opening for particles leaving the cyclone. The particles leaving through the opening 41 have a direction component that is generally directed perpendicular to the axis of rotation R of the vortex created in the cyclone chamber 26.

The collecting container 27 is, with the exception of the previously-mentioned wall part 31 and cover plate 37, surrounded by an end wall 44, a bottom wall 45, and side walls 46. One side wall merges with the spiral-shaped wall 43 of the channel 42, as illustrated in FIG. 7. The bottom wall 45, at its external side, is provided with a locking shoulder 47, the function of which will be explained below.

The coarse separator 25, the cyclone chamber 26, and the collecting container 27 are each provided with a completely open end wall that is normally covered by the cover plate 37. The cover plate 37 is normally secured on the liner 14 and is removed when the collecting container 27 is to be emptied.

Figure 5:
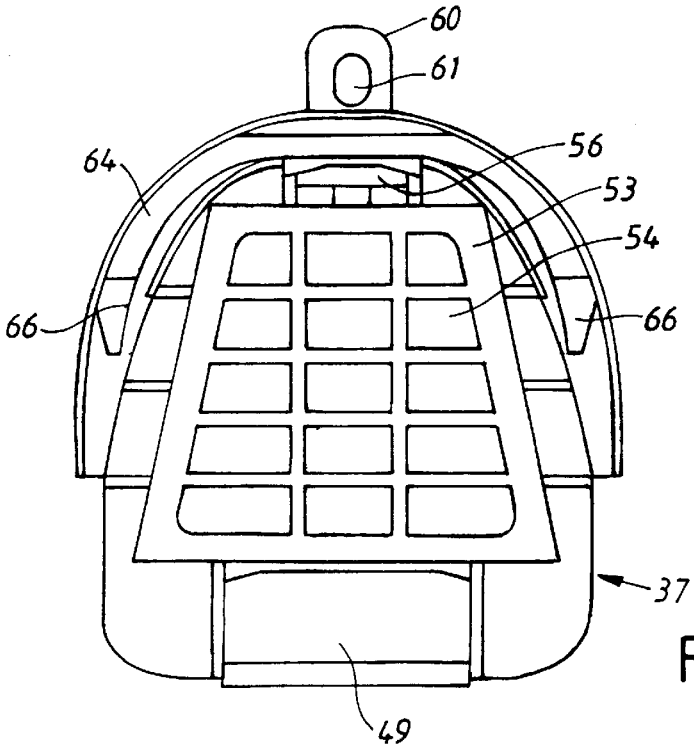
FIG. 5 is an end view of the liner as seen from the right hand side in FIG. 4, but with the cover plate secured to the liner.
Figure 8:
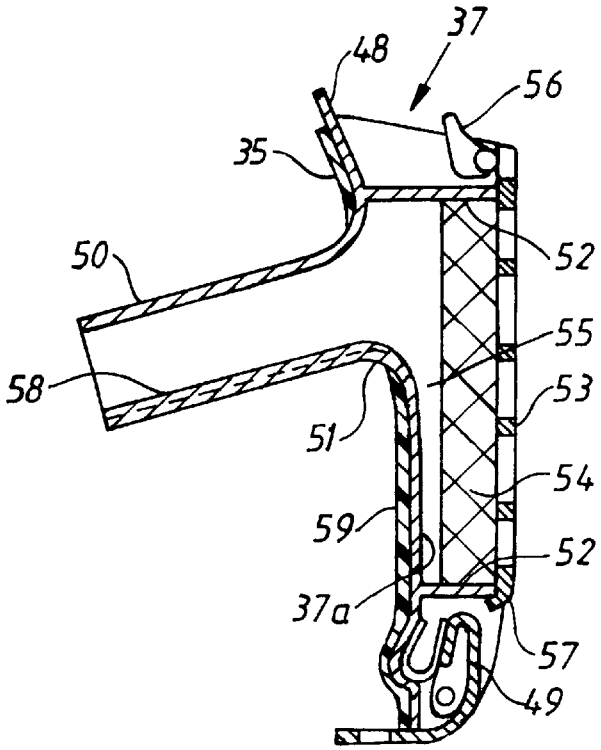
FIG. 8 is a vertical section through the cover plate.
Figure 9:
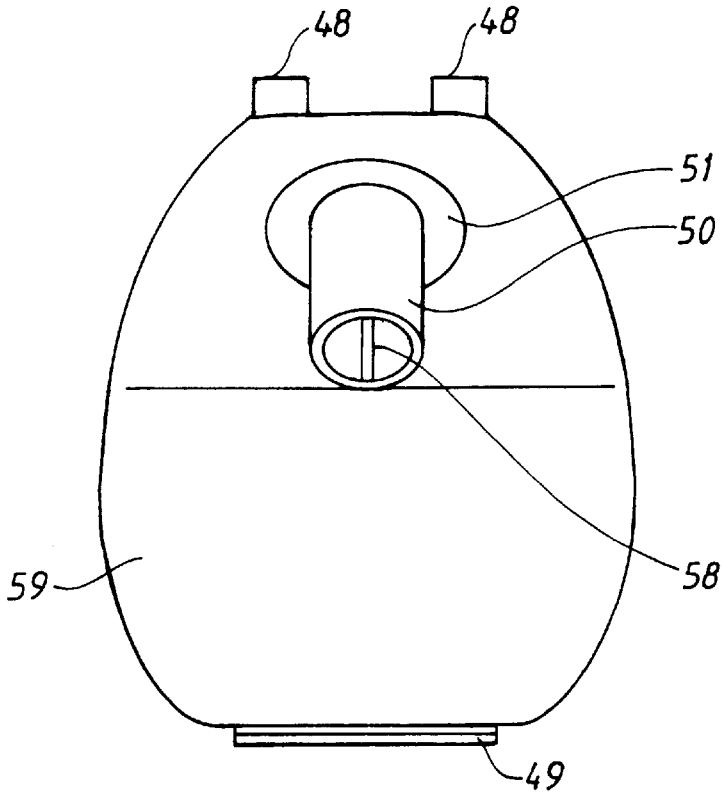
FIG. 9 is the cover plate in a front view from the left hand side in FIG. 8.

With reference to FIGS. 5, 8, and 9, the cover plate 37 includes an angled plate 37*a* having two lugs 48 and a spring-loaded latching hook 49. The lugs 48 are inserted into recesses (not shown) in the liner 14 whereas the latching hook 49 engages the locking shoulder 47 on the liner 14 in order to releasably lock the cover plate 37 to the liner 14.

The cover plate 37 also has a circular tube 50 extending from the angled plate 37*a*. The tube 50 is provided with a rounded portion 51 at one tube end interconnecting the tube 50 and the angled plate 37*a*. The cover plate 37 has, at the opposite side of the angled plate 37*a* relative to the tube 50, a wall portion 52 surrounding a filter cassette 53 that receives a so-called deep filter 54. The deep filter 54 is, for example, a thick, coarse filter that can be picked out from the cassette 53 and cleaned, for instance, in a dishwasher. The filter 54 is spaced from the angled plate 37*a*, thereby creating a space 55 for the distribution of air flowing through the tube 50 to the complete area of the filter 54. The filter cassette 53 is retained on the cover plate 37 by cooperation between a locking mechanism 56 on the cover plate 37 and lugs 57 arranged on the cassette.

In order to decrease the creation of noise, the tube 50 has, at its internal side, an axially-directed flange or rib 58 preventing the creation of a vortex within the tube 50. The angled plate 37*a* is, at the side from which the tube 50 extends, provided with a soft material layer 59 that serves as a sealing member when the cover plate 37 is secured to the liner 14.

With reference to FIGS. 4 and 6, the liner 14 includes a handle 60 that also serves as a handle for the complete vacuum cleaner. The handle 60 includes a knob or button 61 that is operable to release the liner 14 from the vacuum cleaner housing 10. The knob 61 is under the influence of a spring 62 and is, via an arm 63, connected to a yoke member 64. The yoke member 64 is supported for turning motion about shafts 65 arranged at each side of the liner 14. Each side of the yoke member 64 is provided with a hook 66 that engages a shoulder or the like (not shown) in the vacuum cleaner housing 10. The liner 14 is also provided with a holder 67 cooperating with, and partly surrounding, the end wall 22 of the vacuum cleaner housing 10.

In order to get proper particle separation conditions, the diameter of the cyclone chamber 26 is preferably within the range of 50–100 mm, the length of the cyclone is within the range of about 100≈300 mm, and the distance between the opening 39 and the second end wall 36 is more than 20 mm. The length of the tube 50 is preferably 20–50% of the length of the cyclone. The cassette locking mechanism 56 is preferably designed to act on the yoke member 64 such that the hook 66 of the yoke member 64 does not engage the vacuum cleaner housing 10 when the cassette 53 is missing from the cover plate 37.

The vacuum cleaner described above operates and is used in the following manner. Dust-laden air taken up by the vacuum cleaner nozzle 5 flows through the tube shaft 6 and the hose 8 into the tube section 23. The air flows via the inlet opening 29 into the coarse separator 25 and continues toward the end that is covered by the cover plate 37. Heavier particles are separated from the air flow in the coarse separator 25 because of the reduction of the air velocity and the air deflection at the opening 32. The separated particles are collected on the wall part 31 that serves as a bottom of the coarse separator 25. After deflection, the air flow continues through the opening 32 and further through the inlet channel 33 toward the cyclone chamber 26.

Air flows tangentially into the cyclone chamber 26 and near the first end wall 35 between the side wall of the cyclone chamber 26 and the tube 50, the tube 50 being indicated by dash-dotted lines in FIG. 4. This means that a vortex is created about the central axis of rotation R in the intermediate part 38 of the cyclone chamber 26. Due to centrifugal forces, dust particles are distributed toward the second end wall 36, pass through the opening 38, and into the separation part 40. The particles are thrown out mainly perpendicular to the rotational axis through the opening 41 and the channel 42 into the collecting container 27, which is placed outside the separation part 40, and collect on the bottom 45 of the collecting container 27.

The air at the central part of the vortex, which is substantially free of large particles, is drawn out via the tube 50 of the cover plate 37 and flows through the space 55 and the filter 54 in which further particles are separated. The air continues through the inlet part 17 and the openings 16 into the motor fan unit 15, and then leaves to atmosphere via the outlet filter 19 in which smaller particles are separated.

When the vacuum cleaner is emptied, the liner 14 is first removed from the vacuum cleaner housing 10 by depressing the knob 61 on the handle 60. Depressing the knob 61 causes the yoke member 64 to pivot about the shafts 65 such that the hook 66 disengages from the shoulder (not shown) in the vacuum cleaner housing 10. Thus, the liner 14 can be turned somewhat about the front part and then lifted out of the recess 13 in the vacuum cleaner housing 10. The cover plate 37 is then removed from the liner 14 by depressing the latching hook 49, which means that the plate 37 disengages from the locking shoulder 47 on the liner 14 to permit the cover plate to be tilted and the fastening lugs 48 drawn out from the recesses (not shown).

Turning the liner 14 up-side-down simultaneously empties all the material that was collected in the cavities, i.e. the collecting container 27, the coarse separator 26 and the cyclone chamber 25, into a bin or the like. The arrangement also allows all the cavities 25, 26, 27 to be easily cleaned since the end walls (cover plate 37) of the cavities are completely removed and, hence, all parts of the cavities are accessible without further disassembly or the need for special cleaning tools.

If necessary, the filter cassette 53 can be released from the cover plate 37 by depressing the locking mechanism 56, and then the filter 54 can be picked out and cleaned. After cleaning, the filter 54 and the filter cassette 53 are again secured to the cover plate 37. Then the cover plate 37 is fixed to the liner 14 which is placed in the recess 13 such that the filter cassette 53 abuts the inclined sealing plane 18. Application of additional pressure will then allow the hooks 66 to engage the shoulders (not shown) in the vacuum cleaner housing 10.

An optional emptying ring (not shown) may be used to facilitate emptying of the cavities 25, 26, 27. Such an emptying ring is shaped such that it corresponds to the part of the liner 14 on which the cover plate 37 is normally secured. The cover plate 37 is removed from the liner 14 and a conventional plastic bag is placed within the emptying ring. The open end of the bag is folded about the ring after which the emptying ring is manually pressed toward the liner. The liner 14 with the emptying ring and the bag is then turned up-side-down such that the dust falls down into the bag. The bag and the emptying ring can then be separated from the liner 14 and from one another after which the bag can be closed and thrown away.

Figure 10:
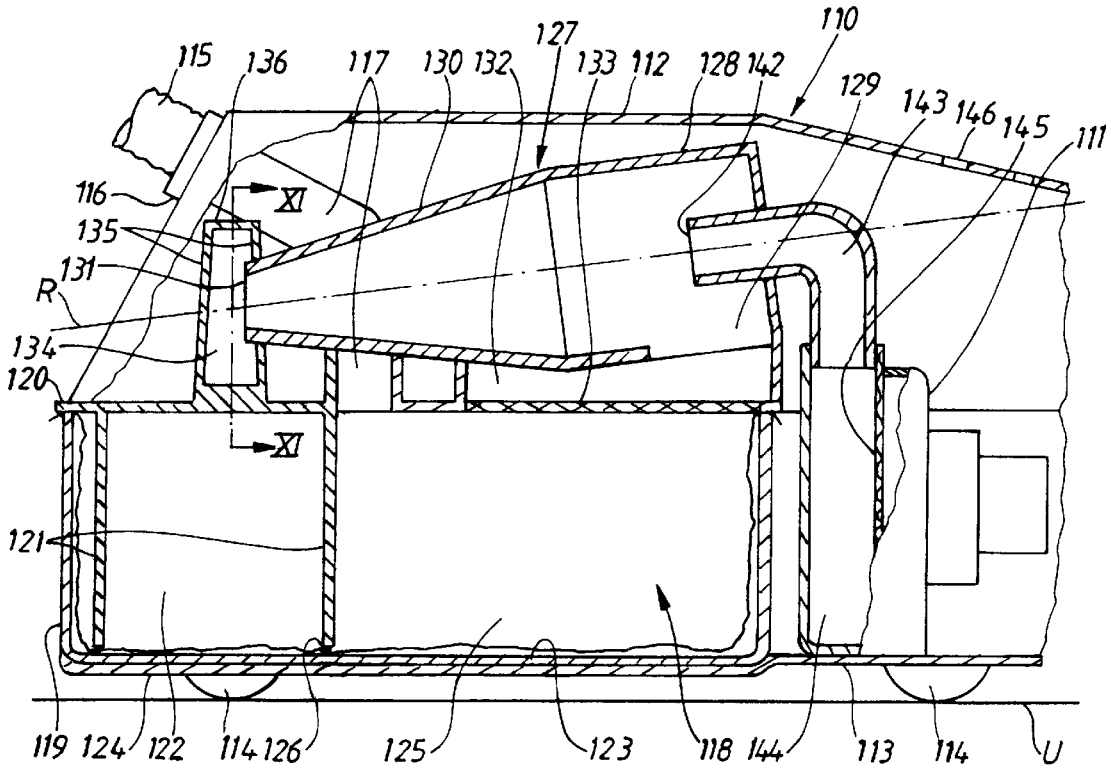
FIG. 10 is a vertical section through a second embodiment of the invention.

With reference to FIG. 10, a canister vacuum cleaner comprising a chassis 110 enclosing a vacuum source in the form of a motor-fan unit 111 is illustrated. The chassis 110 comprises an upper part 112 and a lower part 113 that are removably secured to one another by locking means (not shown). The chassis 110 is supported for movement by means of several wheels 114 arranged on the lower part 113. A hose 115 is, in a conventional way, connected to a tube coupling 116 at the upper part 112 of the chassis 110 and the hose 115 is connected to a tube shaft that supports a nozzle. A tube coupling 116 continues into a tube shaped inlet 117 which opens into an upper part of a coarse separator 118.

The coarse separator 118 is partly limited by a trough-shaped container 119, partly by a plate 120, and partly by an intermediate wall 121 integrated with the plate 120. The plate 120, which serves as a cover and belongs to the upper chassis part 112, defines the parting plane between the upper and lower parts 112, 113. The intermediate wall 121 separates a space 122 within the container 119 from the other parts of the container 119. The space 122 extends from the plate 120 down into the bottom 123 of the container.

The container 119 is removably arranged on a chassis portion 124, which is shaped as a support, and is inwardly dressed with a bag 125. Preferably, the bag 125 is a plastic bag whose edges are clamped between edge parts of the plate 120 and upper edge portions of the container 119. A lower part of the intermediate wall 121 is provided with a sealing 126 that presses the bag 125 against the bottom 123 of the container.

The upper part 112 of the chassis 110 is provided with a cyclone separator 127 that, in a conventional way, comprises a cylindrical part 128 having a tangentially-directed inlet 129 and an associated part 130. The associated part 130 is shaped as a truncated cone having an outlet opening 131 for particles separated by the cyclone. The inlet 129 is, via an air passage 132, connected to the coarse separator 118. The air passage 132 is covered by a grating 133 or the like preventing larger particles from reaching the cyclone.

The cyclone is placed such that the rotational axis R of the vortex created when the vacuum cleaner is used on a horizontal surface U is mainly directed horizontally. The expression "mainly directed horizontally" in this context means that the angle between the horizontal plane and the axis should be less than 45° and preferably less than 30°. The particle outlet opening 131 of the cyclone separates the cyclone chamber from a separation part 134. The separation part 134 has walls 135 that are mainly directed perpendicular to the length direction of the cyclone and are connected to one another by means of a wall part 136. The separation part 134 also has an outlet opening 137 that is placed above the space 122, which means that particles separated by the cyclone fall down into the space 122.

Figure 11:
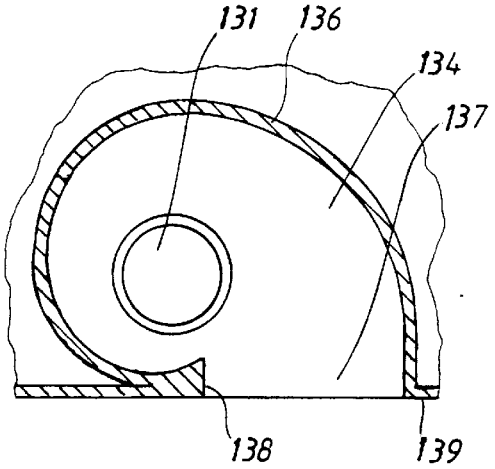
FIG. 11 is a section as seen along line XI—XI in FIG. 10, showing a first embodiment of the cyclone particle outlet.

The wall part 136 of the separation part 134 is preferably spiral-shaped, as shown in FIG. 11. The wall part 136 extends from a point 138 vertically below the outlet opening 131 of the cyclone chamber to a point 139 situated beside and below the outlet opening 137. An alternative construction, illustrated in FIG. 12, employs a wall part 140 and several vertically oriented guides 141 placed below the outlet opening 131.

The cyclone is further provided with an air outlet 142 shaped as a sleeve that is disposed centrally within the cylindrical part 128 of the cyclone. The sleeve continues into a tube connection 143 that is removably secured to a chamber 144. The chamber 144 serves as an inlet to the fan unit 111, the inlet being covered by a filter 145. Outlet air from the fan unit 111 leaves through several outlet openings 146 arranged at the upper part 112 of the chassis 110.

Figure 12:
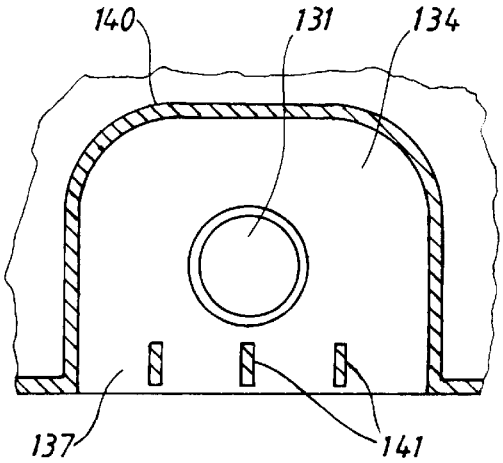
FIG. 12 is an alternative embodiment of the outlet in the same section as FIG. 11.

The device shown in FIGS. 10–12 operates in the following manner. Dust laden air is drawn in by the fan unit 111 from the nozzle through the hose 115 and the inlet 117 of the coarse separator 118. Larger particles are separated and fall down into the bag 125, which is placed on the bottom 123 of the container 119. Partially cleaned air leaves through the grating 133 to the inlet 129 of the cyclone separator 127. Since the inlet 129 is directed tangentially, a vortex is created in the cyclone that directs the particles toward the outlet opening 131 and further into the separation part 134. In the separation part 134, the particles leave the vortex and fall down into the space 122 in which the air is not influenced by the vortex. Cleaned air leaves from the center of the vortex through the outlet 142 and the tube connection 143, via the chamber 144 and the filter 145, to the fan unit 111, and then to ambient via the outlet openings 146.

When the vacuum cleaner is to be emptied, the upper part 112 is removed from the lower part 113. Since the intermediate wall 121 is integrated with the upper part 112, the particles in the space 122 and in the coarse separator 118 will be collected in the common bag 125, which can then be removed from the container 119 and thrown away. A new bag can then be inserted into the container 119 and clamped between the upper and lower parts 112, 113. The container 119 can, of course, also be used without the bag 125, in which case the container 119, when being emptied, is removed from the chassis part 124 that serves as a support means.

Figure 13:
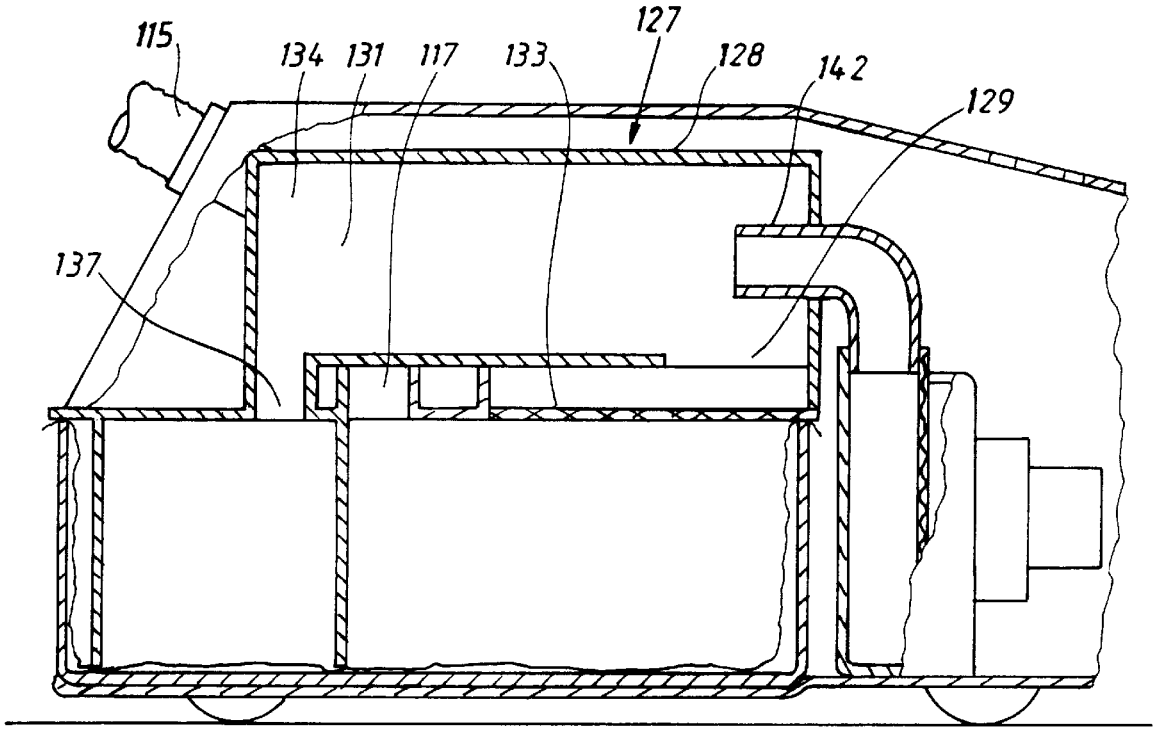
FIG. 13 is a third embodiment of the invention in the same section as FIG. 10; and, FIG. 14 shows a vertical section through a further embodiment of the cyclone of the vacuum cleaner.

The embodiment shown in FIG. 13 (in which relevant parts have the same numbers as in the embodiment shown in FIG. 10) differs from the embodiment according to FIG. 10 with regard to the shape of the cyclone being of the previously-discussed type illustrated in FIGS. 2–9.

Figure 14:
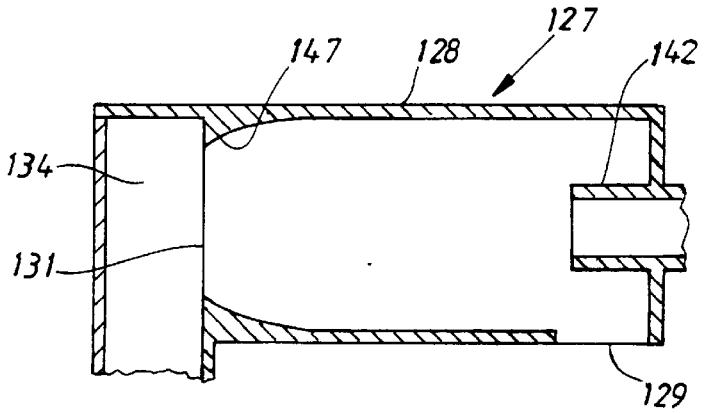

The embodiment shown in FIG. 14 differs from that illustrated in FIG. 10 by the fact that the separation part 134 is separated from the cylindrical part 128 by means of an associating part 147. The associating part 147 is generally shaped as a truncated cone, but wherein the conical surfaces are curved and, at the portion continuing into the separation part 134, forms the outlet opening 131 through which the particles flow into the separation part 134. Thus, the expression "truncated cone" should, in this context, be interpreted more generally than the strict geometric interpretation.

The two embodiments according to FIG. 13 and 14 mainly operate in the same manner as has been described with reference to the embodiment according to FIG. 10–12.

It should be mentioned that even if the mainly horizontal position of the rotation axis of the vortex is preferable, especially with regard to canister cleaners, the arrangement also provides a good result in such designs where a vertical rotation axis is used.

What is claimed is:

1. A device for a vacuum cleaner comprising a cyclone separator having a cyclone comprising a first end wall (35), a second, opposite end wall (135), and an intermediate part (38,130), said intermediate part being either shaped as a cylinder or, at least partly, a truncated cone, the intermediate part has a particle outlet opening (39,131) through which particles separated by the cyclone leave from the intermediate part toward the second end wall, the cyclone, close to the first end wall, being provided with a generally tangentially-directed air inlet (33,129) for dust laden air and having a tube-shaped air outlet (50,142) extending from the first end wall (35) into the intermediate part and communicating with a vacuum source (15,111), wherein said particle outlet opening (39,131) continues into a separation part (40,134) having a side wall opening (41,137) through which particles leave generally perpendicular to an axis of rotation (R) of a vortex created in the cyclone to a particle collecting (27) container placed outside the separation part (40,134).

2. The device according to claim 1, further comprising a coarse separator (25,118) that, with regard to a direction of air flowing through the vacuum cleaner, is connected in series with and before the cyclone.

3. The device according to claim 1, wherein the cyclone is positioned such that said axis of rotation (R) is inclined less than 45° to a horizontal plane when the vacuum cleaner is placed on a horizontal surface (U).

4. The device according to claim 2, wherein the cyclone is positioned such that said axis of rotation (R) is inclined less than 45° to a horizontal plane when the vacuum cleaner is placed on a horizontal surface (U).

5. The device according to claim 1, wherein the side wall opening (41,137) of the separation part (40,134) continues into a channel (42), said channel having a wall (43,136) which, as seen in a direction which is perpendicular to a length of the axis of rotation (R), is spiral-shaped.

6. The device according to claim 2, wherein the side wall opening (41,137) of the separation part (40,134) continues into a channel (42), said channel having a wall (43,136) which, as seen in a direction which is perpendicular to a length of the axis of rotation (R), is spiral-shaped.

7. The device according to claim 3, wherein the side wall opening (41,137) of the separation part (40,134) continues into a channel (42), said channel having a wall (43,136) which, as seen in a direction which is perpendicular to a length of the axis of rotation (R), is spiral-shaped.

8. The device according to claim 4, wherein the side wall opening (41,137) of the separation part (40,134) continues into a channel (42), said channel having a wall (43,136) which, as seen in a direction which is perpendicular to a length of the axis of rotation (R), is spiral-shaped.

9. The device according to claim 2, wherein each of the coarse separator (25), the cyclone, and the collecting container (27) are provided with a wall part that is integral with a removable cover plate (37).

10. The device according to claim 9, wherein the coarse separator (25), the cyclone, the collecting container (27), and the cover plate constitute a removable unit (14) arranged in a vacuum cleaner housing (10).

11. The device according to claim 10, wherein the unit (14) is provided with a handle (60) which, when the unit is placed in the vacuum cleaner housing (10), also serves as a handle for the vacuum cleaner.

12. The device cleaner according to claim 9, wherein the coarse separator (25), the cyclone, and the collecting container (27) have generally equal lengths and are placed beside and parallel to one another, the cover plate (37) being an end wall for the coarse separator, the dust container, and the cyclone chamber.

13. The device cleaner according to claim 10, wherein the coarse separator (25), the cyclone, and the collecting container (27) have generally equal lengths and are placed beside and parallel to one another, the cover plate (37) being an end wall for the coarse separator, the dust container, and the cyclone chamber.

14. The device cleaner according to claim 11, wherein the coarse separator (25), the cyclone, and the collecting container (27) have generally equal lengths and are placed beside and parallel to one another, the cover plate (37) being an end wall for the coarse separator, the dust container, and the cyclone chamber.

15. The device according to claim 9, wherein the tube shaped air outlet (50) is permanently connected to the cover plate (37).

16. The device according to claim 10, wherein the tube shaped air outlet (50) is permanently connected to the cover plate (37).

17. The device according to claim 11, wherein the tube shaped air outlet (50) is permanently connected to the cover plate (37).

18. The device according to claim 12, wherein the tube shaped air outlet (50) is permanently connected to the cover plate (37).

19. The device according to claim 13, wherein the tube shaped air outlet (50) is permanently connected to the cover plate (37).

20. The device according to claim 14, wherein the tube shaped air outlet (50) is permanently connected to the cover plate (37).

21. The device according to claim 1, wherein a length of the cyclone between the end walls (35,36) is between about 100 to 300 mm and a maximum diameter of the cyclone is between about 50 to 150 mm.

22. The device according to claim 21, wherein a length of the tube shaped air outlet (50) extending into the cyclone is between about 20 to 50% of the length of the cyclone.

* * * * *